US009879362B2

(12) United States Patent
Shin et al.

(10) Patent No.: US 9,879,362 B2
(45) Date of Patent: Jan. 30, 2018

(54) METHOD FOR PRODUCING NANOFIBERS CAPABLE OF STORING AND TRANSFERRING NITRIC OXIDE AND NANOFIBERS CAPABLE OF STORING AND TRANSFERRING NITRIC OXIDE PRODUCED THEREBY

(71) Applicant: KWANGWOON UNIVERSITY INDUSTRY-ACADEMIC COLLABORATION FOUNDATION, Seoul (KR)

(72) Inventors: Jae Ho Shin, Seoul (KR); Woo-Young Jung, Seoul (KR); Mingoo Kim, Seoul (KR); Jonghae Youn, Gyeonggi-do (KR)

(73) Assignee: I-SENS, INC., Seoul (KR)

( * ) Notice: Subject to any disclaimer, the term of this patent is extended or adjusted under 35 U.S.C. 154(b) by 0 days.

(21) Appl. No.: 14/772,819

(22) PCT Filed: Mar. 7, 2014

(86) PCT No.: PCT/KR2014/001910

§ 371 (c)(1),
(2) Date: Sep. 4, 2015

(87) PCT Pub. No.: WO2014/137195

PCT Pub. Date: Sep. 12, 2014

(65) Prior Publication Data

US 2016/0010241 A1 Jan. 14, 2016

(30) Foreign Application Priority Data

Mar. 7, 2013 (KR) ..... 10-2013-0024555

(51) Int. Cl.

| | |
|---|---|
| ***D01F 6/36*** | (2006.01) |
| ***D01D 5/00*** | (2006.01) |
| ***D04H 1/728*** | (2012.01) |
| ***D01D 1/02*** | (2006.01) |
| ***D01F 6/88*** | (2006.01) |
| ***D01F 9/08*** | (2006.01) |

(52) U.S. Cl.

CPC ..... *D01D 5/003* (2013.01); *D01D 1/02* (2013.01); *D01D 5/0015* (2013.01); *D01F 6/36* (2013.01); *D01F 6/88* (2013.01); *D01F 9/08* (2013.01); *D04H 1/728* (2013.01)

(58) Field of Classification Search

CPC ..... D01D 5/003; D01D 5/0015

See application file for complete search history.

(56) References Cited

U.S. PATENT DOCUMENTS

| | | | | |
|---|---|---|---|---|
| 6,737,447 | B1 * | 5/2004 | Smith | A61L 15/26 424/426 |
| 2008/0069848 | A1 | 3/2008 | Peters | |
| 2008/0175881 | A1 | 7/2008 | Ippoliti et al. | |
| 2009/0136410 | A1 | 5/2009 | Smith | |
| 2013/0189340 | A1 | 7/2013 | Kim et al. | |
| 2014/0065200 | A1 * | 3/2014 | Schoenfisch | A61K 49/1884 424/443 |
| 2015/0182543 | A1 | 7/2015 | Schoenfisch et al. | |

FOREIGN PATENT DOCUMENTS

| | | | |
|---|---|---|---|
| JP | 2008-545714 | A | 12/2008 |
| KR | 20070105331 | A | 10/2007 |
| KR | 20120035044 | | 4/2012 |

OTHER PUBLICATIONS

International Search Report issued in corresponding application No. PCT/KR2014/001910 dated Jul. 21, 2014 (2 pages).

Nablo, Brian J., et al.; "Nitric oxide-releasing sol-gels as antibacterial coatings for orthopedic implants", Biomaterials, vol. 26, pp. 917-924; 2005 (8 pages).

Wold, Kathryn A., et al.; "Fabrication of Biodegradable Polymeric Nanofibers with Covalently Attached NO Donors"; ACS Applied Marerials & Interfaces, vol. 4, pp. 3022-3030; Jun. 4, 2012 (9 pages).

Coneski, Peter N., et al.; "Nitric Oxide-Releasing Electrospun Polymer Microfibers"; ACS Applied Materials & Interfaces, vol. 3, pp. 426-432; Jan. 20, 2011 (7 pages).

Notice of Rejection (Office Action) dated Oct. 6, 2016, by the Korean Intellectual Property Office in related Korean Patent Application No. KR 10-2013-0024555 (5 pages), with partial English translation (1 page).

* cited by examiner

*Primary Examiner* — Wenwen Cai
(74) *Attorney, Agent, or Firm* — Osha Liang LLP

(57) ABSTRACT

The present invention relates to a method for producing nanofibers storing and transferring nitric oxide, and nanofibers produced thereby. The present invention may include: a filling step for filling a first material with nitric oxide; a synthesis step for synthesizing a second material having a functional group capable of covalently bonding to the first material; a sol-gel reaction step for carrying out a sol-gel reaction of the first material filled with nitric oxide with the second material to produce a gel; and an electrospinning step for electrospinning the gel to produce a nanofiber.

15 Claims, 15 Drawing Sheets

*N*-(6-aminohexyl)aminopropyltrimethoxysilane (AHAP3)

*N*-(2-aminoethyl)-3aminopropyltrimethoxysilane (AEAP3)

(aminoethylaminomethyl)phenethyltrimethoxysilane (AEMP3)

(3-trimethoxysilyl)diethylenetriamine (DET3)

Methylaminopropyltrimethoxysilane (MAP3)

METHOD FOR PRODUCING NANOFIBERS CAPABLE OF STORING AND TRANSFERRING NITRIC OXIDE AND NANOFIBERS CAPABLE OF STORING AND TRANSFERRING NITRIC OXIDE PRODUCED THEREBY

CROSS-REFERENCE TO RELATED APPLICATIONS

This application claims priority to and the benefit of Korean Patent Application No. 10-200x-00xxxxx filed in the Korean Intellectual Property Office on MONTH xx, 200x, the entire contents of which are incorporated herein by reference.

TECHNICAL FIELD

The present invention relates to a method for producing nanofibers capable of storing and transferring nitric oxide, and nanofibers produced thereby, which are capable of storing and transferring nitric oxide. More particularly, the present invention relates to a method for producing silica nanofibers capable of storing and transferring nitric oxide through a sol-gel reaction and an electrospinning process by using aminoalkoxysilane filled with nitric oxide and a polymer having a functional group capable of covalently bonding to the aminoalkoxysilane, and silica nanofibers produced thereby.

BACKGROUND ART

According to recent studies, nitric oxide (NO), a diatomic free radical produced in vivo, is known to be a material playing very important roles in various physiological processes, such as vasodilation, neurotransmission, blood vessel formation, phagocytosis, wound healing, prevention of thrombus formation, prevention of myocardial damage, and immune response. For example, the anti-thrombotic characteristics of the vascular surface are mainly due to the nitric oxide produced in the endothelial cells of the blood vessel inner wall. Nitric oxide produced in the inner wall inhibits the activation and aggregation of platelets by controlling the flow and pressure of the blood. Furthermore, nitric oxide produced in the phagocytic cells fights against micro-organic materials, such as bacteria penetrated into the body. Since nitric oxide facilitates the dilation and formation of blood vessels in addition to these characteristics, nitric oxide is effective in the treatment of wounds, particularly skin that has been burned, and may also prevent bacteria from entering the wound to reduce the risk of infections.

Due to the discovery of the importance of the physiological role of nitric oxide, studies on a method for not only stably storing nitric oxide in a material, but also exactly transferring nitric oxide to a site to be transferred have also been actively carried out. Various materials capable of storing and transferring nitric oxide have been reported. Nitric oxide may be stored in various materials from small molecules to dendrimers, liposomes, nanoparticles, carbon nanotubes, porous particles, and micelles according to the use.

There are many nitric oxide storing materials like this, but in fact, there are not so many materials which may be directly applied to the living body. Among materials capable of storing and transferring nitric oxide or materials having functionality, a material, which is excellent in biocompatibility and may be utilized in the medical field, is nanofiber.

Nanofiber has a structure which is similar to the network structure in vivo in shape, so that studies in that nanofiber exhibits excellent effects at the time of cell culture have been performed, and even in fact, nanofiber tends to be used most frequently in the medical field. Nanofiber is so low in production rate that nanofiber has not been widely nor industrially used until recently, but nanofiber did not come into the spotlight until the mid-1990s when an electrospinning device used in the production of nanofibers was simplified.

Since the electrospinning process employs simpler devices than other production technologies and spinning may be achieved even when most of the polymer solutions or melts are used in a small amount, studies for imparting various structures and functionalities have been actively conducted. If nitric oxide, which is in charge of inducing essential roles in vivo and has been verified of being capable of artificially performing these roles, is added to nanofiber having many advantages as described, advantages presented by both the nanofiber and nitric oxide may be maximally utilized. Studies on nanofibers capable of storing and transferring nitric oxide are still in the initial step and many research results have not been published, so that the studies are expected to be actively conducted in the future.

When several research results are simply introduced, first, there is a method of mixing small molecules capable of storing nitric oxide with a polymer capable of being electrospun by a physical method, and then producing nanofibers (Coneski, P. N.; Nash, J. A.; Schoenfisch, M. H. ACS Appl. Mater. Interfaces. 2011, 3, 426-432). When nanofibers are produced by this method, molecules which store nitric oxide physically included in the nanofibers are likely to easily escape out of the nanofibers. Even though nanofibers are produced by using polymer materials known to be biocompatible, there is a problem in that it is impossible to know what side effects a nitric oxide storing material, which has escaped therefrom, may cause.

Next, there is a method of producing nanofibers by using a material in which nitric oxide is stored in the form of S-nitrosothiol (RSNO) (Wold, K. A.; Damodaran, V. B.; Suazo, L. A.; Bowen, R. A. ACS Appl. Mater. Interfaces. 2012, 4, 3022-3030). The method is a method of storing nitric oxide by using a chemical reaction to convert a functional group of a polymer into another material and producing nitric oxide in the form of SNO, and refers to RSNO. The method is advantageous in that there are various materials, which may be produced, because the method may be applied to a molecule which is capable of being substituted with the polymer while carrying sulfur at the end of the molecule. However, since S and N of RSNO consist of a very weak sigma bond, there is a disadvantage in that S and N have characteristics of being easily decomposed even by light, so that it is not easy to control release characteristics of nitric oxide.

In order to solve these problems, in the present study, aminoalkoxysilane, which is a material of storing nitric oxide in the form of N-diazeniumdiolate, was used and a polymer having a functional group capable of carrying out a sol-gel reaction with aminoalkoxysilane while being capable of producing nanofiber, was synthesized. Diazeniumdiolate substituted with an amine group is usually present in a stable state while forming a resonance structure, and when a sol-gel reaction of aminoalkoxysilane including the diazeniumdiolate with a polymer capable of being electrospun is carried out, the two materials form a chemical bond by forming a siloxane bridge (Si—O—Si). For this reason, it is possible to prevent aminoalkoxysilane, which stores nitric oxide, from escaping out of the nanofiber, and as a result, the nanofiber may be classified into a nanofiber having excellent biocompatibility.

CITATION LIST

Non-Patent Document (Non-Patent Document 1) 1. Coneski, P. N.; Nash, J. A.; Schoenfisch, M. H.; ACS Appl. Mater. Interfaces. 2011, 3, 426-432

(Non-Patent Document 2) 2. Wold, K. A.; Damodaran, V. B.; Suazo, L. A.; Bowen, R. A.; ACS Appl. Mater. Interfaces. 2012, 4, 3022-3030

SUMMARY OF THE INVENTION

The present invention has been made in an effort to provide a method for producing nanofibers which are capable of stably storing and transferring nitric oxide by carrying out a sol-gel reaction of a material filled with nitric oxide with a polymer while forming a chemical bond with nitric oxide during the filling process of nitric oxide and have excellent biocompatibility, and nanofibers produced thereby, which store and transfer nitric oxide.

An exemplary embodiment of the present invention may be a method for producing nanofibers storing and transferring nitric oxide, the method including: a filling step for filling a first material with nitric oxide; a synthesis step for synthesizing a second material having a functional group capable of covalently bonding to the first material; a sol-gel reaction step for carrying out a sol-gel reaction of the first material filled with nitric oxide with the second material to produce a gel; and an electrospinning step for using an electrospinning process to produce a nanofiber with a gel.

The first material may include a material which has an amine group in the molecule and has an alkoxy group capable of carrying out a sol-gel reaction, and specifically, may include aminoalkoxysilane.

The second material may be a polymer capable of being electrospun, and may include a material having a functional group capable of carrying out a sol-gel reaction in the molecule, or having a functional group capable of carrying out a sol-gel reaction through combination with another material even though the material has no functional group capable of carrying out a sol-gel reaction.

The filling step may be carried out by a process of dissolving the first material in a solvent (ethanol, methanol), and then increasing the pressure of nitric oxide in a reactor.

Nanofibers capable of storing and transferring nitric oxide may be produced by using a sol-gel reaction to allow aminoalkoxysilane and the polymer to form a chemical bond, and electrospinning the solvent.

Another exemplary embodiment of the present invention may be a nanofiber capable of storing and transferring nitric oxide, which is produced by the aforementioned exemplary embodiment, and the nanofiber may include silica nanofibers.

According to exemplary embodiments of the present invention, a nanofiber capable of storing and transferring nitric oxide may be produced by using a sol-gel reaction and an electrospinning process. Since nitric oxide filled forms a chemical covalent bond with aminoalkoxysilane, it is the biggest advantage that nitric oxide may be stably stored in nanofibers compared to simply storing nitric oxide by a physical method. When nitric oxide is stored by a physical method, it is advantageous in that the method of storing nitric oxide is simple, but it is highly likely that the material capable of storing nitric oxide may be leaked out of nanofibers, and it is impossible to know what adverse effects in vivo the material may cause. For this reason, a chemical bond of a polymer used in the production of the nanofiber with aminoalkoxysilane is very important, and it may be seen as an essential process to form the chemical bond.

According to exemplary embodiments of the present invention, it is possible to variously control release characteristics of the nitric oxide by controlling the kind and concentration of aminoalkoxysilane and the weight ratio of a polymer solution.

DETAILED DESCRIPTION

Figure 1:
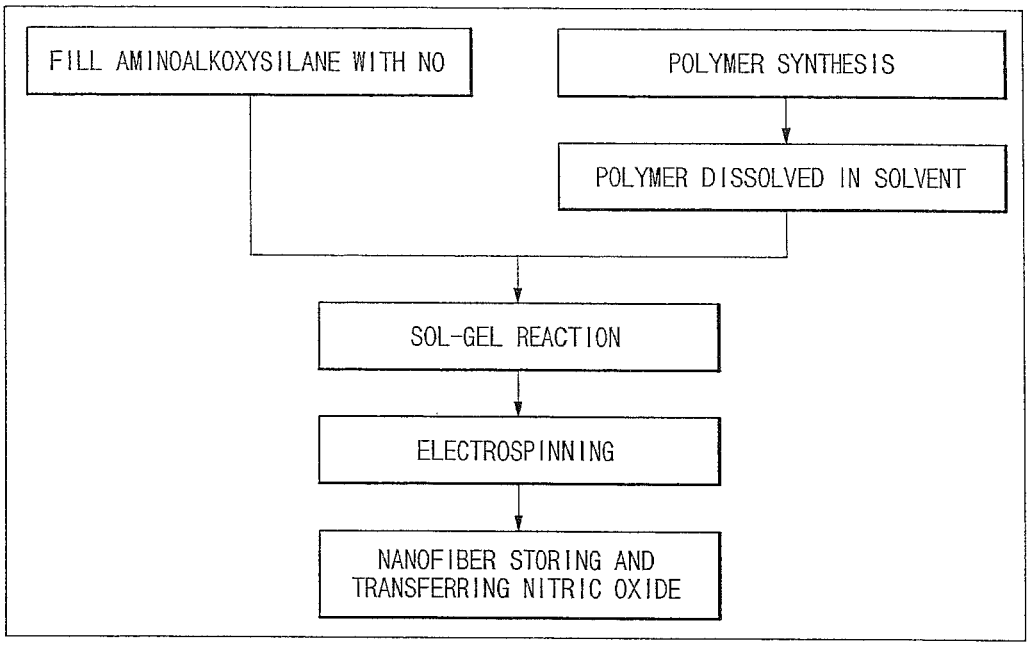
FIG. 1 is a flow diagram illustrating a process of producing nanofibers according to an exemplary embodiment of the present invention.

Hereinafter, preferred exemplary embodiments of the present invention will be described with reference to the accompanying drawings. The exemplary embodiments of the present invention may be modified into various other forms, and the scope of the present invention is not limited to the exemplary embodiments to be described below. Further, the exemplary embodiments of the present invention are provided to more fully explain the present invention to a person with ordinary skill in the art. Thus, the shape, size and the like of elements in the drawings may be exaggerated for more clear explanation, and the elements denoted by the same reference numerals on the drawings are the same elements.

Referring to FIG. 1, an exemplary embodiment of the present invention may be a method for producing nanofibers storing and transferring nitric oxide, the method including: a filling step for filling a first material with nitric oxide; a synthesis step for synthesizing a second material having a functional group capable of covalently bonding to the first material; a sol-gel reaction step for carrying out a sol-gel reaction of the first material with the second material to produce a gel; and an electrospinning step for electrospinning the gel to produce a nanofiber.

The present embodiment relates to a method for producing nanofibers which store and transfer nitric oxide. The nanofiber may include silica nanofibers. The nanofiber may mean a fiber having a nanometer-scale diameter. The silica nanofiber may mean a nanofiber including silica, and may also contain other components in addition to silica. Hereinafter, the production method will be sequentially described.

First, a first material may be filled with nitric oxide (a filling step).

The first material may include a material which has an amine functional group in the molecule and has an alkoxy group capable of carrying out a sol-gel reaction. Specifically, the first material may include aminoalkoxysilane. Aminoalkoxysilane may include one or more selected from the group consisting of N-(6-aminohexyl)aminopropyltrimethoxysilane (AHAP3), N-(2-aminoethyl)-3-aminopropyltrimethoxysilane (AEAP3), N-(2-aminoethyl)aminophenethyltrimethoxysilane (AEMP3), (3-trimethoxysilylpropyl) diethylenetriamine (DET3), methylaminopropyltrimethoxysilane (MAP3), N-(acetylglycyl)-3-aminopropyltrimethoxysilane, N-(3-acryloxy-2-hydroxypropyl)-3-aminopropyltriethoxysilane, N-(2-aminoethyl)-3-aminoisobutylmethyldimethoxysilane, N-(2-aminoethyl)-3-aminopropylmethyldiethoxysilane, N-(2-aminoethyl)-3-aminopropylmethyldimethoxysilane, N-(2-aminoethyl)-3-aminopropylsilanetriol, N-(2-aminoethyl)-3-aminopropyltriethoxysilane, N-(6-aminohexyl) aminomethyltriethoxysilane, N-(2-aminoethyl)-11-aminoundecyltrimethoxysilane, N-[3-amino (polypropylenoxy)]aminopropyltrimethoxysilane, 3-aminopropylsilanetriol, N-(2-N-benzylamino ethyl)-3-aminopropyl trimethoxysilane hydrochloride, and a combination thereof.

The first material may be filled with nitric oxide by a process of dissolving the first material in a solvent, and then increasing the pressure of nitric oxide. Nitric oxide may form a covalent bond with an amino functional group in aminoalkoxysilane under high pressure, and aminoalkoxysilane may be filled with nitric oxide in this manner. The nitric oxide filled and hydrogen ions in the aqueous solution may be released again under relatively high temperature conditions. The alkoxysilane moiety in aminoalkoxysilane may be involved in a subsequent sol-gel reaction to form a network structure. The first material filled with nitric oxide may be present in the form of N-diazeniumdiolate.

Figure 2A:
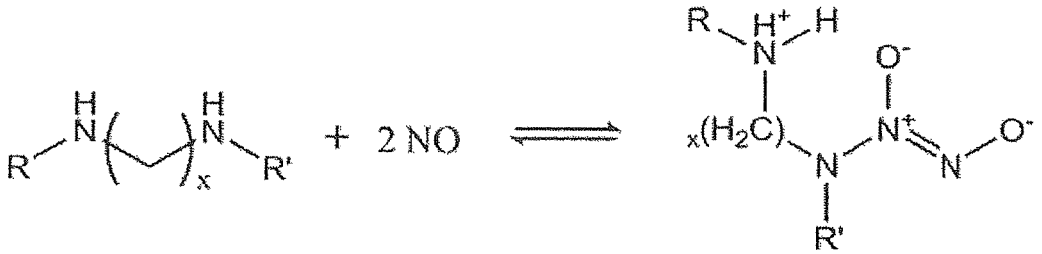
FIG. 2 is a schematic view explaining the filling and release of nitric oxide according to an exemplary embodiment of the present invention by chemical structural formulae.
Figure 2B:
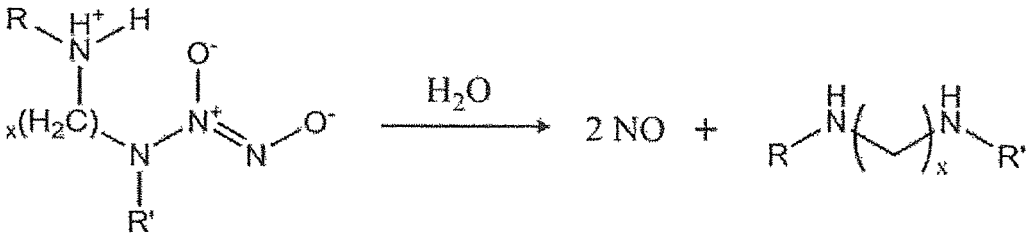

FIG. 2 illustrates a schematic view of the filling and release of nitric oxide (FIG. 2(A): filling, FIG. 2(B): release). Referring to FIG. 2, the nitric oxide (NO) filled may form a covalent form to be present in the form of N-diazeniumdiolate, and may maintain a relatively stable filling state.

Figure 3:
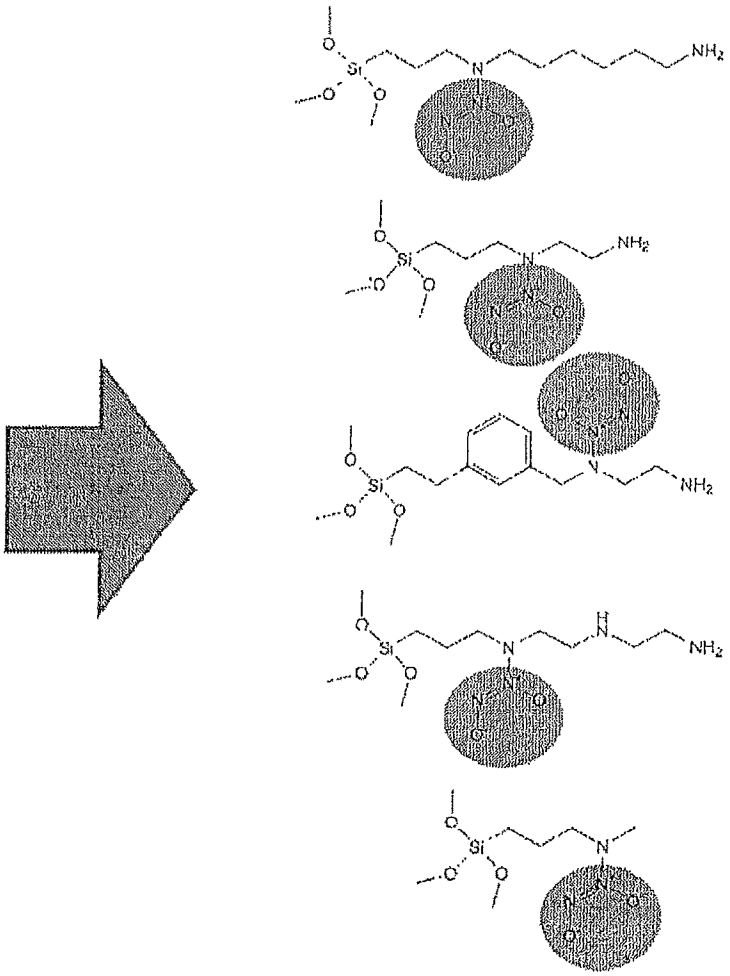
FIG. 3 is a schematic view chemically and structurally explaining the filling of nitric oxide for each kind of aminoalkoxide according to an exemplary embodiment of the present invention.

FIG. 3 illustrates a schematic view in which each aminoalkoxysilane is filled with nitric oxide. Referring to FIG. 3, nitric oxide may form a covalent bond with an amino group of aminoalkoxysilane at high pressure. In this case, ethanol and methanol may be used as a solvent, and sodium methoxide may be used in order to stably protect a covalent bond of nitric oxide and aminoalkoxysilane. Sodium ions in the solvent may serve to block hydrogen ions which approach diazeniumdiolate in a filled form, thereby preventing nitric oxide from being decomposed. A reagent (dehydrate) from which water has been removed may be used in all of ethanol, methanol, and sodium methoxide, so as to minimize the nitric oxide filled from being decomposed.

Next, it is possible to synthesize a second material having a functional group capable of covalently bonding to the first material (a synthesis step).

The second material may be a polymer capable of being electrospun, and may include a material having a functional group capable of carrying out a sol-gel reaction in the molecule, or having a functional group capable of carrying out a sol-gel reaction through combination with another material even though the material has no functional group capable of carrying out a sol-gel reaction.

Specifically, the second material may include one or more selected from the group consisting of nylon-6,6 (PA-6,6), polyurethanes (PU), polybenzimidazole (PBI), polycarbonate (PC), polyacrylonitrile (PAN), polyvinyl alcohol (PVA), polylactic acid (PLA), polyethylene-co-vinyl acetate (PEVA), polymethacrylate (PMA), polyethylene oxide (PEO), polyaniline (PANI), polyvinylcarbazole, polyethylene terephthalate (PET), polyacrylic acid-polypyrenemethanole (PAA-PM), polystyrene (PS), polymethylmethacrylate (PMMA), polyamide (PA), polyvinylphenol (PVP), polyvinylchloride (PVC), cellulose acetate (CA), polyvinyl alcohol (PVA), polyacrylamide (PAAm), poly(lactic-co-glycolic acid) (PLGA), collagen, polycaprolactone (PCL), poly(2-hydroxyethyl methacrylate) (HEMA), poly(vinylidene fluoride) (PVDF), polyether imide (PEI), polyethylene glycol (PEG), nylon-4,6 (PA-4,6), poly(ferrocenyldimethylsilane) (PFDMS), poly(ethylene-co-vinyl alcohol), polyvinyl pyrrolidone (PVP), polymetha-phenyleneisophthalamide, and a combination thereof.

In the present step, the second material may be synthesized by dissolving a precursor of the second material in a solvent, and introducing a reaction initiator into the resulting solution to carry out polymerization.

The precursor of the second material may have a functional group capable of covalently bonding to the first material. The functional group capable of covalently bonding to the first material is not involved in a reaction in the present synthesis step, and the first material and the second material may form a network structure through the present functional group in the subsequent sol-gel reaction process.

The solvent is not particularly limited as long as the solvent may dissolve the precursor of the second material. Specifically, an organic solvent, such as toluene, tetrahydrofuran (THF), and dimethylformamide (DMF), may be used as the solvent.

The reaction initiator is not particularly limited as long as the reaction initiator may initiate the polymerization of the precursor of the second material. Specifically, it is possible to use an azo compound such as azobisisobutyronitrile (AIBN) and a peroxide, such as benzoyl peroxide, acetyl peroxide, dilauryl peroxide, di-tert-butyl peroxide, cumylhydroperoxide, hydrogen peroxide, and potassium persulfate, as the initiator.

Figure 4:
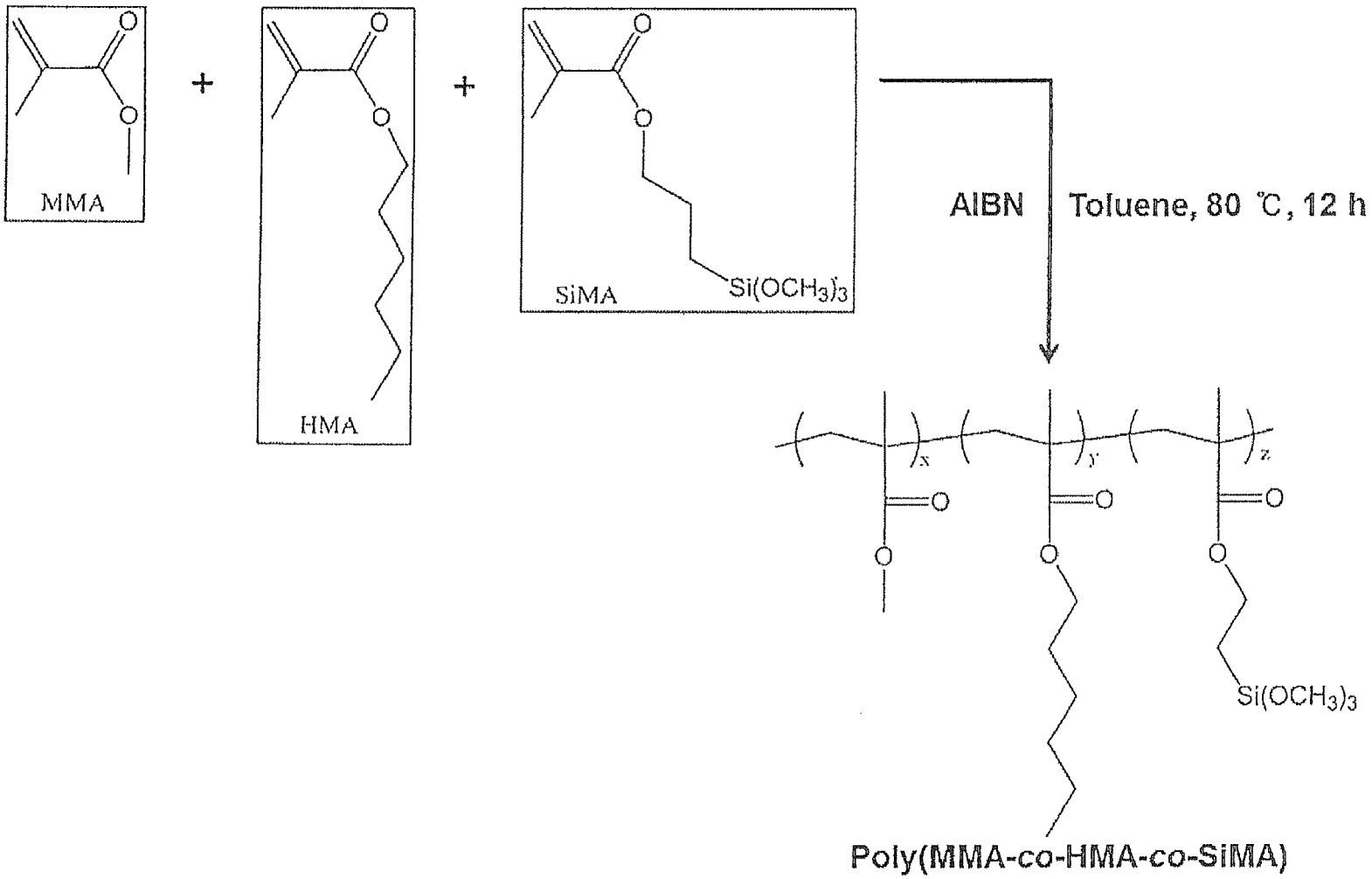
FIG. 4 is a schematic view chemically and structurally explaining a process of producing a second material according to an exemplary embodiment of the present invention.

FIG. 4 schematically illustrates a process of synthesizing the second material poly(MMA-co-HMA-co-SiMA) by dissolving methylmethacrylate (MMA), hexylmethacrylate (HMA), and (trimethoxysilylpropyl)methacrylate (SiMA) in toluene, and then using AIBN as the reaction initiator. Referring to FIG. 4, the second material synthesized has a —Si(OCH3)3 functional group, and the a —Si(OCH3)3 functional group may be reacted with the first material in a subsequent sol-gel reaction to contribute to forming a network structure.

Next, it is possible to produce a gel in which the first material filled with nitric oxide and the second material form a network structure by carrying out a sol-gel reaction of the first material filled with nitric oxide with the second material (a sol-gel reaction step).

The sol-gel reaction is a process for chemically bonding aminoalkoxysilane (the first material) filled with nitric oxide to a polymer (the second material). The general sol-gel reaction is easily carried out even at normal temperature, and the temperature may be lower or higher than normal temperature under conditions in which properties thereof are not changed. The sol-gel reaction includes steps of a hydrolysis reaction which is initiated by adding water, and a condensation reaction which is initiated by a catalyst. The rate of the reaction may be controlled by controlling the amount of water, or controlling the kind or amount of catalyst, which is variously present, to change the pH, and the degree of the reaction may be differently carried out just by controlling the time from several minutes to several tens of hours. In general, hydrochloric acid is frequently used as an acid catalyst, and aqueous ammonia is frequently used as a base catalyst, but acetic acid or KOH and the like are also used, and a metal such as gold or copper and aluminum may also be used as the catalyst. The alkoxide moiety of the first material and the $—Si(OCH_3)_3$ moiety of the second material may be bound to each other by the sol-gel reaction, thereby forming a network structure.

Figure 5:
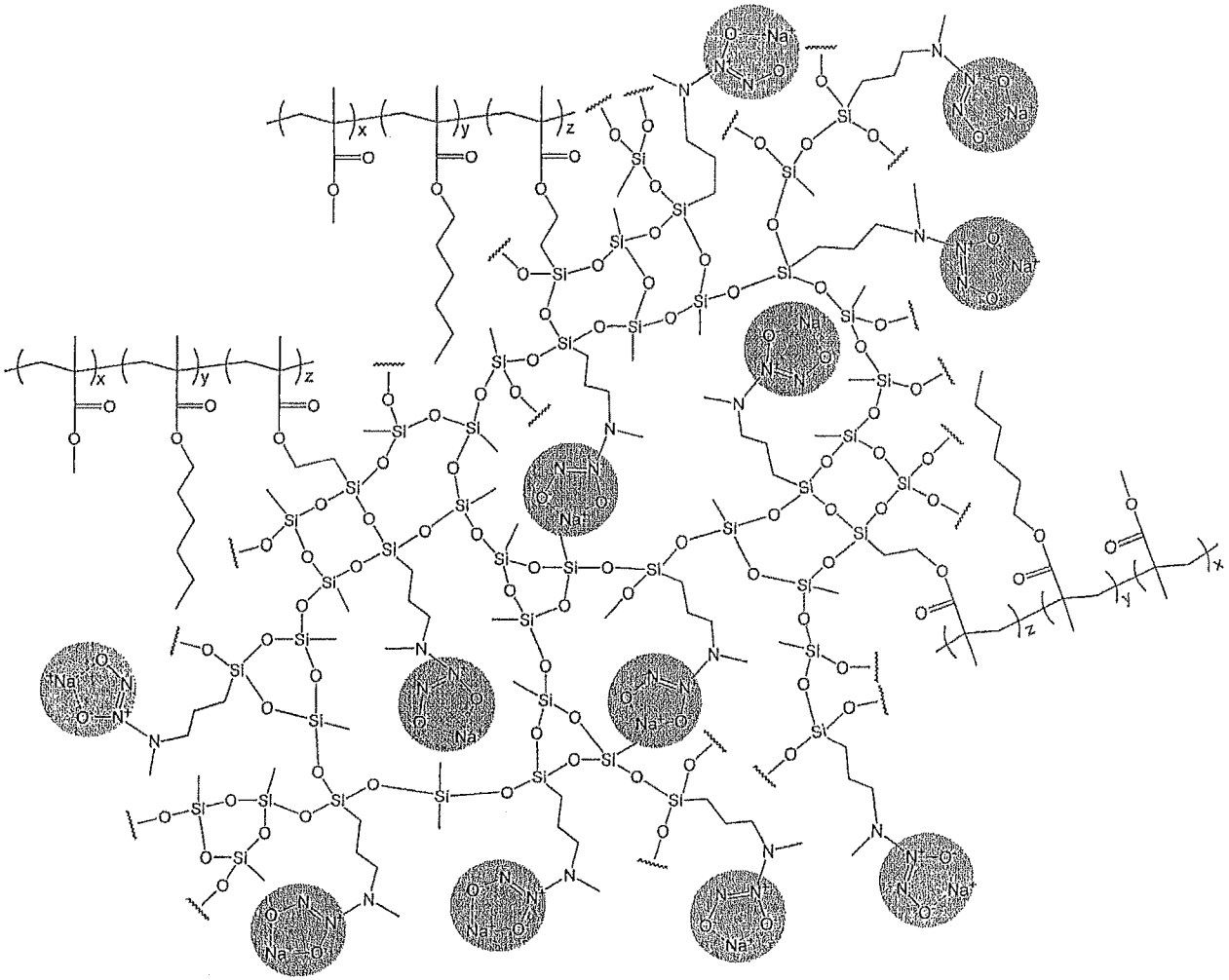
FIG. 5 is a schematic view chemically and structurally illustrating the network structure of the first material and the second material formed by a sol-gel reaction according to an exemplary embodiment of the present invention.

FIG. 5 schematically illustrates a network structure formed by a sol-gel reaction of aminoalkoxysilane (MAP3) filled with nitric oxide and the second material (poly(MMA-co-HMA-co-SiMA)). Referring to FIG. 5, the nitric oxide filled still forms a covalent bond and may be stably present in a network structure.

The sol-gel reaction may be carried out at −10 to 30° C. and a pH of 5 to 10 for 1 to 6 hours. When the temperature is lower than −10° C., a problem in that the reaction rate is slowed down may occur, and when the temperature is higher than 30° C., a problem in that nitric oxide filled in aminoalkoxysilane is released may occur. When the pH is lower than 5, the number of hydrogen ions is increased, so that a problem in that nitric oxide filled in aminoalkoxysilane is released may occur due to the characteristics of diazeniumdiolate decomposed by hydrogen ions, and when the pH is higher than 10, a problem in that molecules form a particle because the rate of the sol-gel reaction is increased, and thus, a polymer solution capable of being electrospun is not generated may occur. When the reaction time is shorter than 1 hour, the reaction time may be short in forming a network structure, and when the reaction time is longer than 6 hours, a concern in that the viscosity is increased due to the progress of the sol-gel reaction, a problem in that nitric oxide is released due to the extension of the reaction, and the like may occur.

Next, a nanofiber may be produced by electrospinning the gel (an electrospinning step).

Figure 6:
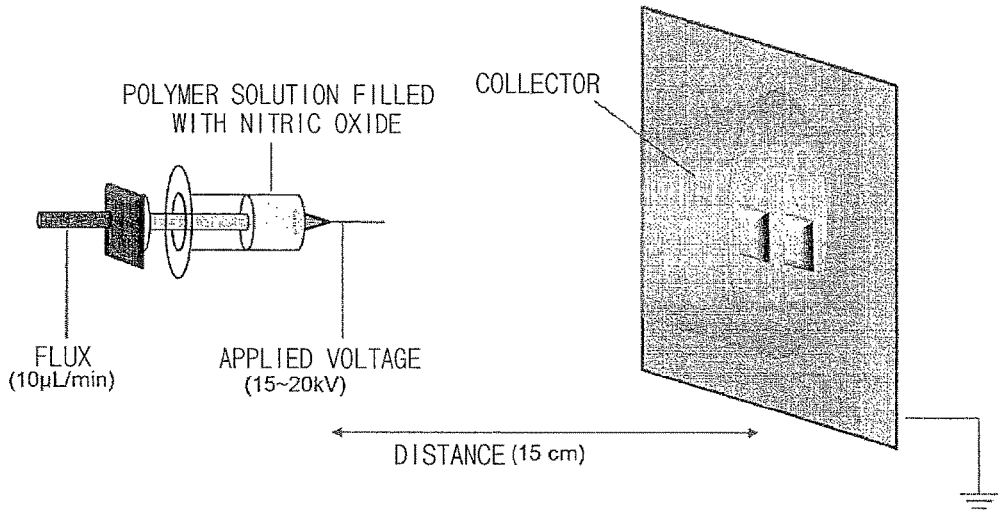
FIG. 6 is a schematic view illustrating the principle of an electrospinning process.
Figure 7A:
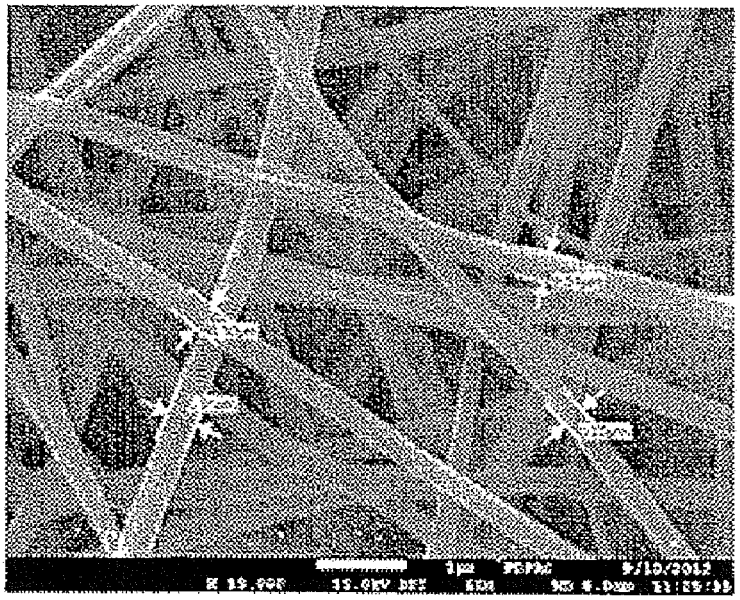
FIG. 7 is scanning electron microscope photographs of nanofibers produced according to Examples 1 to 5 ((A) is Example 1, (B) is Example 2, (C) is Example 3, (D) is Example 4, and (E) is Example 5).
Figure 7B:
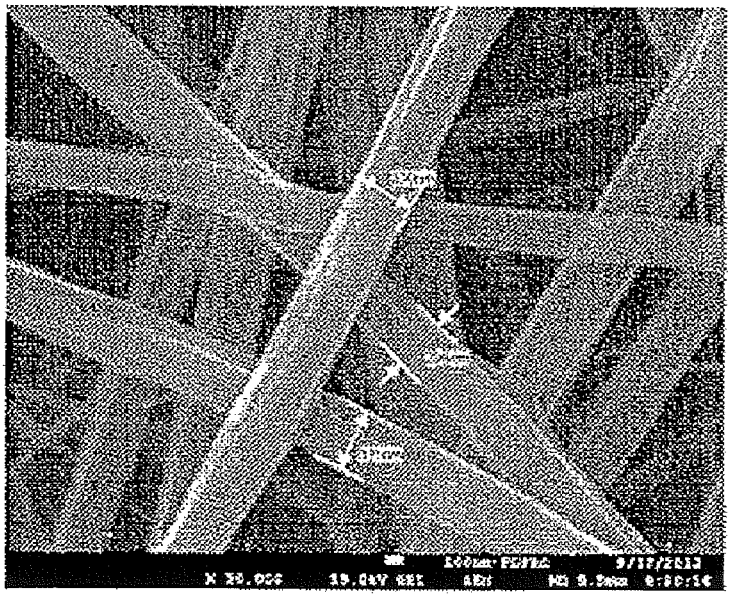
Figure 7C:
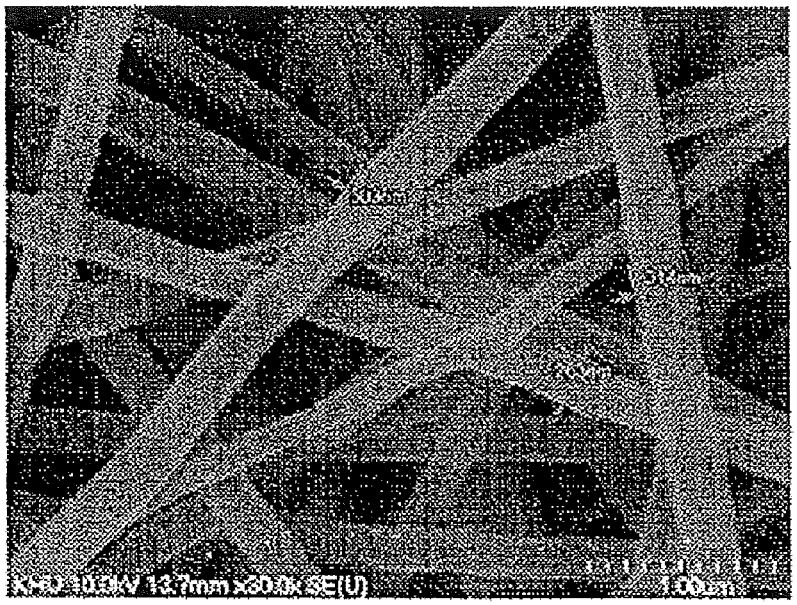
Figure 7D:
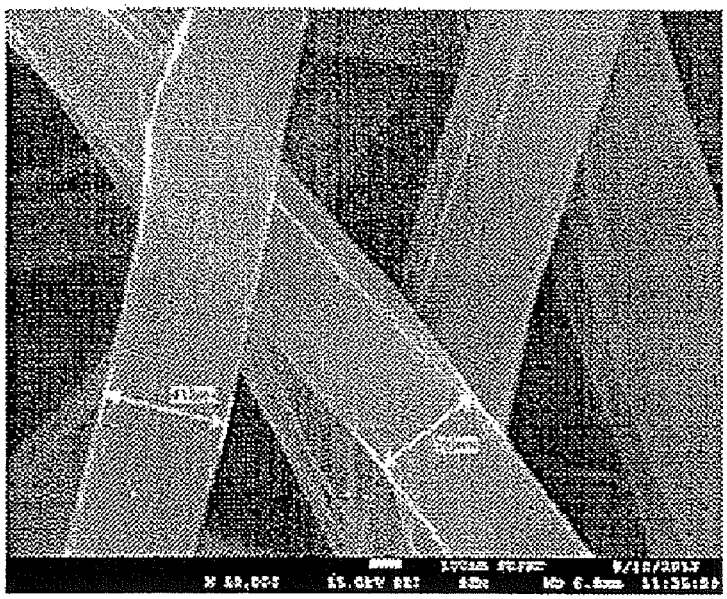
Figure 7E:
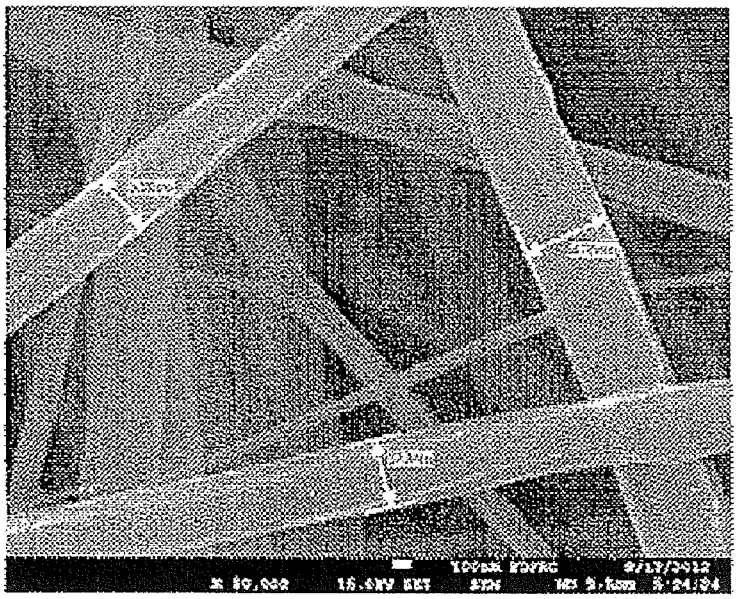

FIG. 6 illustrates a schematic view of the electrospinning process. The electrospinning process is a method frequently used in producing nanofibers. When the principle is observed, the polymer solution forms an equilibrium between gravity and surface tension at the tip of a capillary tube vertically disposed, that is, at a spinneret, and forms a hemispherical drop and allows the drop to be suspended at the tip. In this case, when an electric field is applied thereto, a force opposite to the surface tension is generated, thereby making the hemispherical drop elongate in a conical form. When the electric field is increased to a certain intensity or more, the charged polymer solution forms a taylor corn while overcoming the surface tension, and the solution is continuously released from the jet. Specifically, the jet stream should not collapse when the viscosity is high, and the solvent is thoroughly evaporated while the jet is streaming in the air toward a grounded collector plate, and a charged continuous-phase polymer fiber is accumulated on the collector plate. During the movement, the jet of the polymer solution appears as a force in which the surface area is increased by repulsive force of the electrostatic field, and as a result, the diameter of fiber may be decreased to the nano size. If the molecular weight is sufficiently high and the solvent may be completely evaporated before the jet reaches a collector, most of the polymer may be a nanofiber through electrospinning.

Another exemplary embodiment of the present invention may be a nanofiber capable of storing and transferring nitric oxide, which is produced by the aforementioned exemplary embodiments. Specifically, the nanofiber may include silica nanofibers.

The nanofiber according to the present exemplary embodiment is filled with nitric oxide, and aminoalkoxysilane filled with nitric oxide forms a covalent bond with a polymer skeleton, and thus, does not escape out of the nanofibers. Accordingly, when the nanofiber is applied to an actual product, the release amount and release time of nitric oxide may be stable, and the reliability of the product may be enhanced.

Hereinafter, the present invention will be described in more detail through the Examples and the Comparative Examples.

EXAMPLE 1

<Filling with Nitric Oxide>

5 mmol of AHAP3, which is aminoalkoxysilane, and 5 mmol of sodium methoxide were added to a mixed solution in which ethanol and methanol were mixed at a ratio of 4:1, and nitric oxide (NO) was maintained at 5 to 10 atm at normal temperature for 3 days to fill aminoalkoxysilane with nitric oxide. The filling was carried out along with stirring in a stainless steel reactor which may withstand up to 40 atm. Before the filling of nitric oxide, a process of filling argon up to 10 atm, and then releasing argon was rapidly repeated three times in order to remove oxygen, which may be present along with the solvent in the reactor, and the other gasses, which may affect the reaction. And then, the process of filling argon up to 10 atm, and then releasing argon was further repeated two times at an interval of 10 minutes, and the reactive gases are allowed to be removed from the inside of the reactor. Next, the pressure of nitric oxide in the reactor was maintained at 10 atm for 3 days. After 3 days, a solution filled with nitric oxide was obtained in the reactor, and the solution was vacuum treated when not being used, and was stored at −20° C.

<Synthesis of Polymer Having Functional Group Capable of Carrying Out Sol-Gel Reaction>

60 mol % of methylmethacrylate (MMA), 20 mol % of hexylmethacrylate (HMA), and 20 mol % of trimethoxysilylpropyl)methacrylate (SiMA) were added to toluene, and azobisisobutyronitile (AIBN) as a synthesis initiator was dissolved in methanol and was added to the resulting solution for 30 minutes, and then a reaction was carried out at 80° C. for 12 hours to synthesize a polymer. After the synthesis, toluene was removed by using distillation under reduced pressure and vacuum drying, and purification with hexane was performed three times to remove the remaining monomer and the catalyst, and then the vacuum drying was performed again.

<Sol-Gel Reaction of Aminoalkoxysilane Filled with Nitric Oxide with Polymer>

A polymer solution was produced such that the weight of the polymer produced was 20 wt % and the weight of acetone, which is a solvent to dissolve the polymer, was 80 wt %, 3 g of the polymer solution was extracted, 6.4 mol % (0.3 mmol) of methyltrimethoxysilane (MTMOS) and 4.3 mol % (0.2 mmol) of aminoalkoxysilane (AHAP3) filled with nitric oxide were mixed therein, 45.4 mg of aluminum acetylacetonate as a catalyst and water were added to the mixture, and the sol-gel reaction was carried out to obtain a solution present in a state where the polymer and aminoalkoxysilane (AHAP3) were chemically bound. In this case, the sol-gel reaction temperature was set to 4° C., the pH was set to 7, and the reaction time was set to 1 hour. The sol-gel reaction was carried out along with stirring.

<Electrospinning>

The solution was put into a syringe, and a nanofiber having a nanometer-scale diameter was produced by using an electrospinning device. The conditions during the electrospinning were as follows. The size of the needle was set to 18 gauge, the distance between the needle and the collector was set to 20 cm, the voltage was set to 20 kV, and the flow rate was set to 10 μl/min.

EXAMPLES 2 to 5

A nanofiber was produced in the same manner as in Example 1, except that as aminoalkoxysilane, AEAP3 (Example 2), DET3 (Example 3), MAP3 (Example 4), and AEMP3 (Example 5) were used instead of AHAP3.

EXAMPLES 6 to 10

A nanofiber was produced in the same manner as in Example 1, except that 2.1 mol % (Example 6), 4.3 mol % (Example 7), 6.4 mol % (Example 8), 8.6 mol % (Example 9), and 10.7 mol % (Example 10) of AHAP3 were used, and MTMOS was added thereto such that the sum of AHAP3 and MTMOS was 10.7%.

Evaluation

A scanning electron microscope (SEM, Hitachi S-4700) was used to observe the surface coated with the nanofiber by electrospinning and measure the size (diameter). The size (diameter) of the nanofiber was measured by measuring 15 portions from the scanning electron microscope photograph, and then calculating the average value thereof.

FIG. 7 illustrates scanning electron microscope photographs of nanofibers produced according to Examples 1 to 5. Referring to FIG. 7, it can be confirmed that the nanofibers were stacked in a network shape to have a porous structure, and the diameter of the nanofiber was smallest in Example 1 and largest in Example 4.

FIG. 9 illustrates scanning electron microscope photographs of nanofibers produced according to Examples 6 to 10. Referring to FIG. 9, it can be confirmed that the nanofibers were stacked in a network shape to have a porous structure, and the diameter of the nanofiber was smallest in Example 10.

The Sievers chemiluminescence nitric oxide analyzer (NOA280i) was used to measure the total release amount of nitric oxide (t[NO]), the half-life ($t_{1/2}$), the maximum release flow rate ($[NO]_m$), the time ($t_m$) required to reach the maximum release flow rate, and the release duration time ($t_d$).

TABLE 1

| | Sol-gel | | Fiber size | T[NO] (μmol · mg$^{-1}$) | $t_{1/2}$ | [NO]m | $t_m$ | $t_d$ |
|---|---|---|---|---|---|---|---|---|
| | Aminoalkoxysilane | alkoxysilane | (nm) | | (min) | (ppb · mg$^{-1}$) | (min) | (h) |
| Example 1 | AHAP3 4.3% | MTMOS | 350 | 0.29 | 73 | 580 | 4 | 35 |
| Example 2 | AEAP3 4.3% | 6.4% | 331 | 0.30 | 182 | 500 | 4 | 39 |
| Example 3 | DET3 4.3% | | 427 | 0.82 | 26 | 3800 | 2 | 29 |
| Example 4 | MAP3 4.3% | | 414 | 0.44 | 17 | 1750 | 2 | 30 |
| Example 5 | AEMP3 4.3% | | 328 | 0.27 | 200 | 310 | 5 | 40 |

TABLE 2

| | Sol-gel | | | T[NO] | | [NO]m | | | Contact |
|---|---|---|---|---|---|---|---|---|---|
| | Aminoalkoxysilane (AHAP3) | Alkoxysilane (MTMOS) | Fiber size (nm) | (μmol · mg$^{-1}$) | $t_{1/2}$ (min) | (ppb · mg$^{-1}$) | $t_m$ (min) | $t_d$ (h) | angle (°) |
| Example 6 | 2.1% | 8.6% | 568 | 0.18 | 218 | 200 | 2 | 41 | 140 |
| Example 7 | 4.3% | 6.4% | 788 | 0.31 | 123 | 800 | 2 | 44 | 138 |
| Example 8 | 6.4% | 4.3% | 535 | 0.44 | 24 | 2400 | 2 | 30 | 107 |
| Example 9 | 8.6% | 2.1% | 589 | 0.64 | 10 | 5200 | 2 | 28 | — |
| Example 10 | 10.7% | 0% | 230 | 1.19 | 8 | 9600 | 5 | 30 | — |

FIG. 1 illustrates the result of evaluating release characteristics of nitric oxide while varying the kind of aminoalkoxysilane. It can be confirmed that various characteristics were possessed according to the aminoalkoxysilane used, and a desired amount of nitric oxide may be transferred for a desired time based on this result.

FIG. 2 illustrates a result of evaluating release characteristics of nitric oxide while varying the concentration of AHAP3 among the aminoalkoxysilanes. It was confirmed that characteristics of storing and transferring nitric oxide could be changed by not only using various aminoalkoxysilanes, but also controlling the concentration of each aminoalkoxysilane.

Referring to Tables 1 and 2, it can be confirmed that release characteristics of nitric oxide may be variously controlled by controlling the kind and concentration of aminoalkoxysilane. Release characteristics of nitric oxide are independently and specifically required for each portion of the organism, and release characteristics of nitric oxide required for each portion may be satisfied by appropriately controlling the kind of aminoalkoxysilane and the concentration of aminoalkoxysilane. Accordingly, the nanofibers produced according to the present invention may be variously applied to each portion of the organism.

The result of additionally measuring the contact angle was attached to FIG. 2. The contact angle means a relative angle between the surface coated with nanofibers and the water drop placed on the surface. When the contact angle between the surface and the water drop is 90° or less, the surface refers to hydrophilic, when the contact angle is 90° or more, the surface refers to hydrophobic, and when the contact angle is 150° or more, the surface refers to superhydrophobic. It can be seen as a meaning of minimizing the area, which is in contact with water, and maximally blocking the approach of water molecules that the contact angle is large. Since diazeniumdiolate, which is a nitric oxide donor used in the production of nanofibers which store and transfer nitric oxide, has characteristics of being decomposed by water, it is preferred to minimize the approach of water in order to release nitric oxide for a long time. Referring to Table 2, it can be confirmed that the larger the contact angle is, the more the release half-life of nitric oxide is increased.

Figure 8:
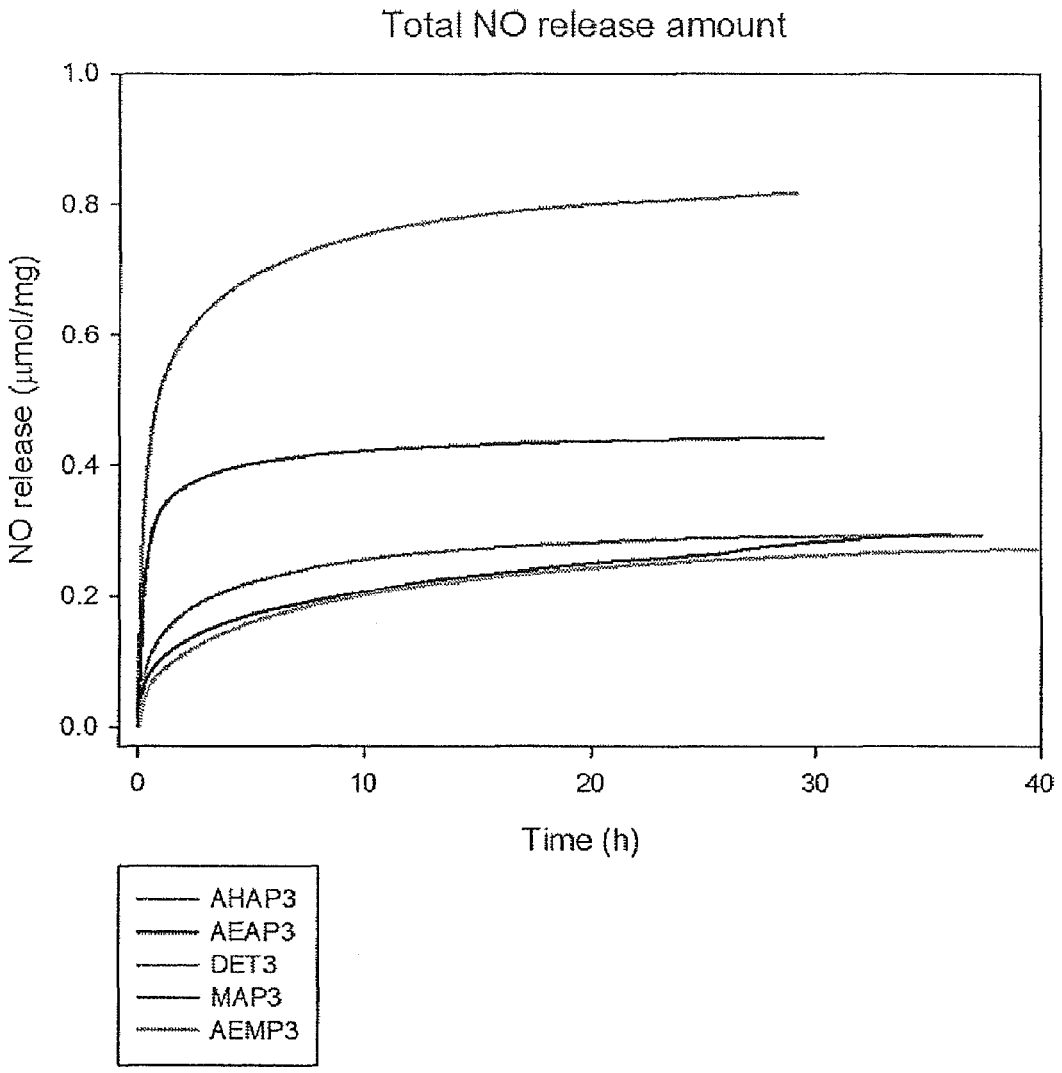
FIG. 8 is a graph illustrating the total release amount of nitric oxide from the nanofibers of Examples 1 to 5 over time.
Figure 9A:
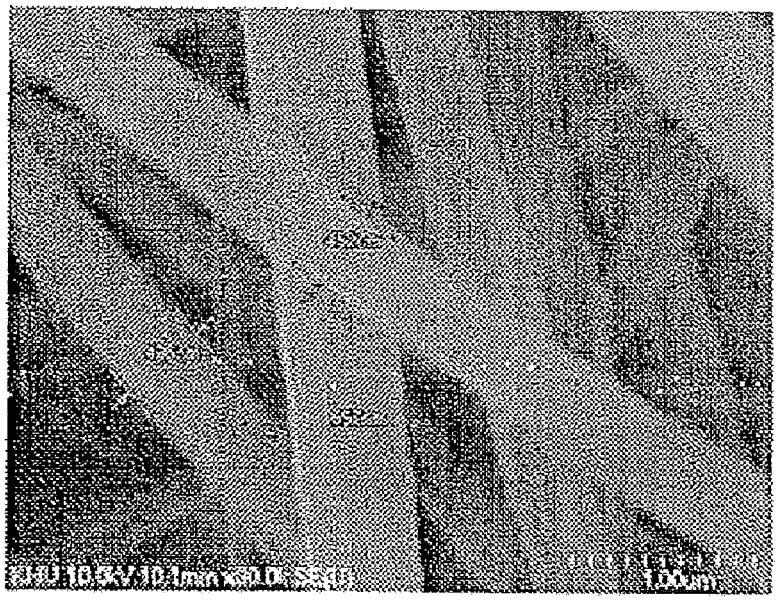
FIG. 9 is scanning electron microscope photographs of nanofibers produced according to Examples 6 to 10 ((A) is Example 6, (B) is Example 7, (C) is Example 8, (D) is Example 9, and (E) is Example 10).
Figure 9B:
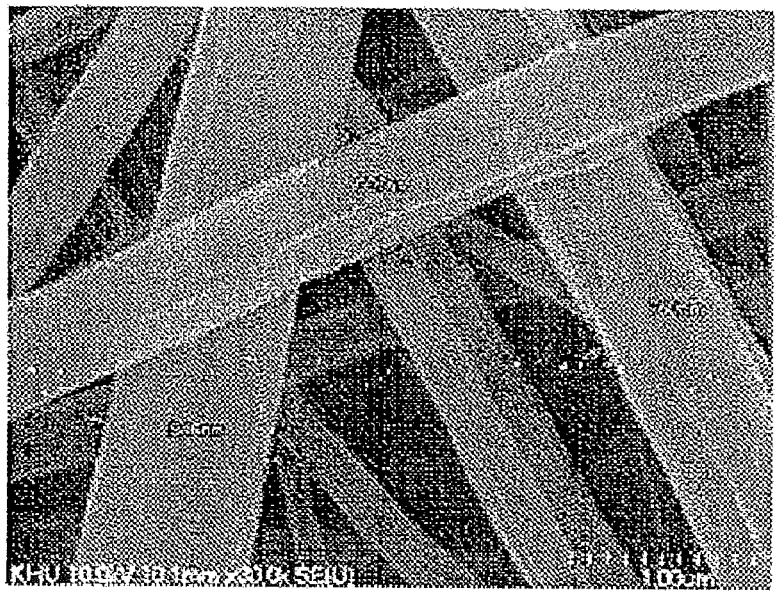
Figure 9C:
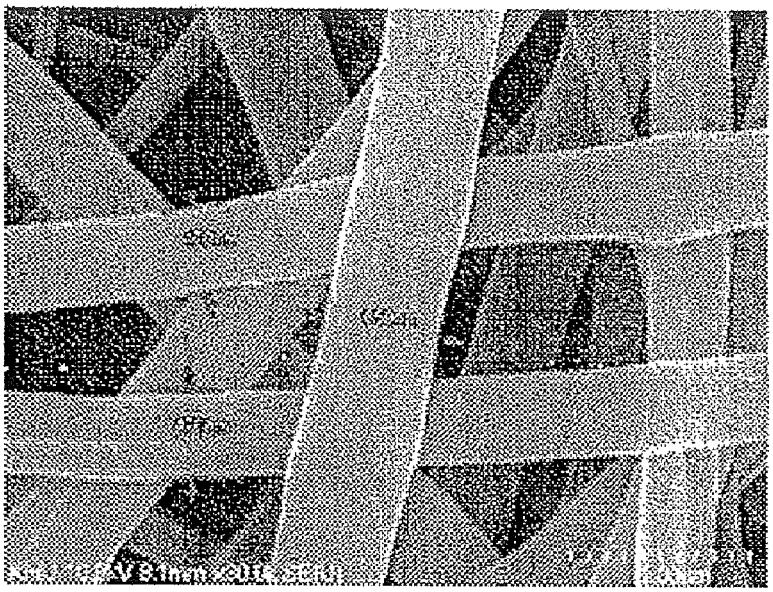
Figure 9D:
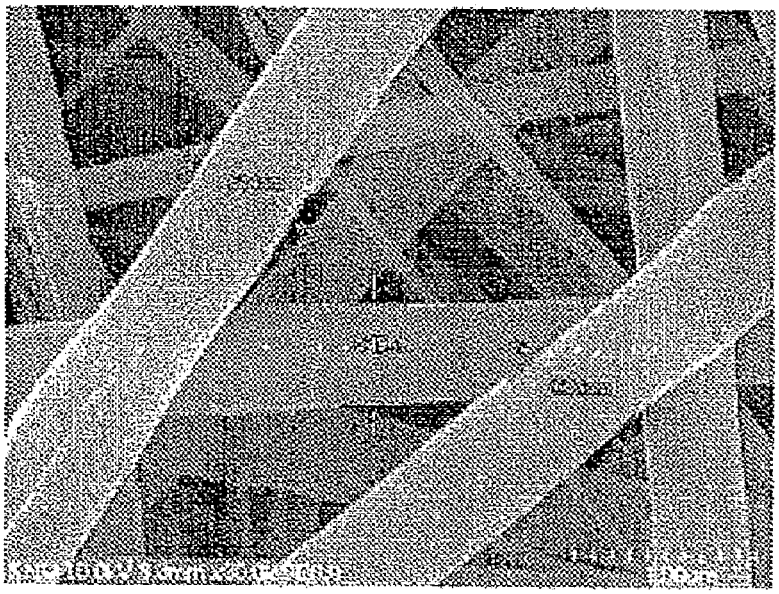
Figure 9E:
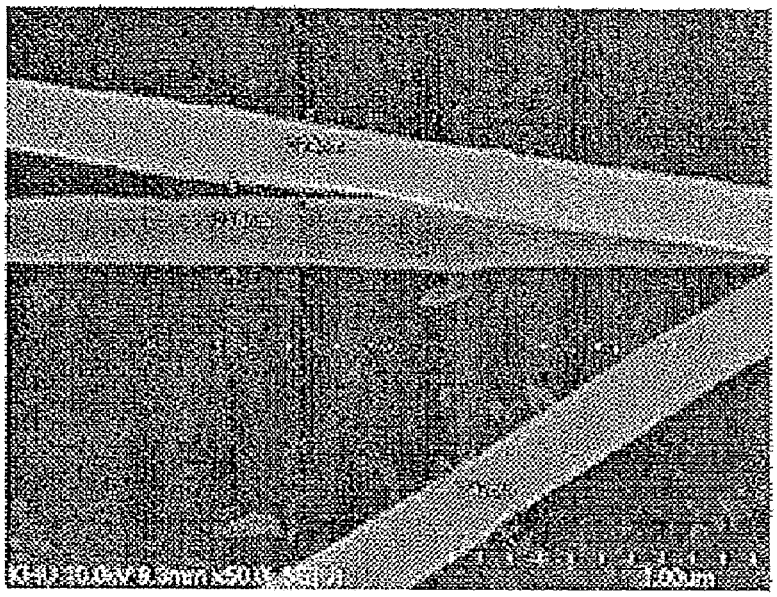

FIG. 8 illustrates the release cumulative amount of nitric oxide over time in nanofibers produced according to Examples 1 to 5. Referring to FIG. 8, it can be seen that the release amount of nitric oxide is decreased and the rate of increase in the cumulative amount is decreased as time passes, and it can be confirmed that the case of Example 3 (DET3) is largest and the case of Example 5 (AEMP3) is smallest in the total release amount of nitric oxide.

Figure 10:
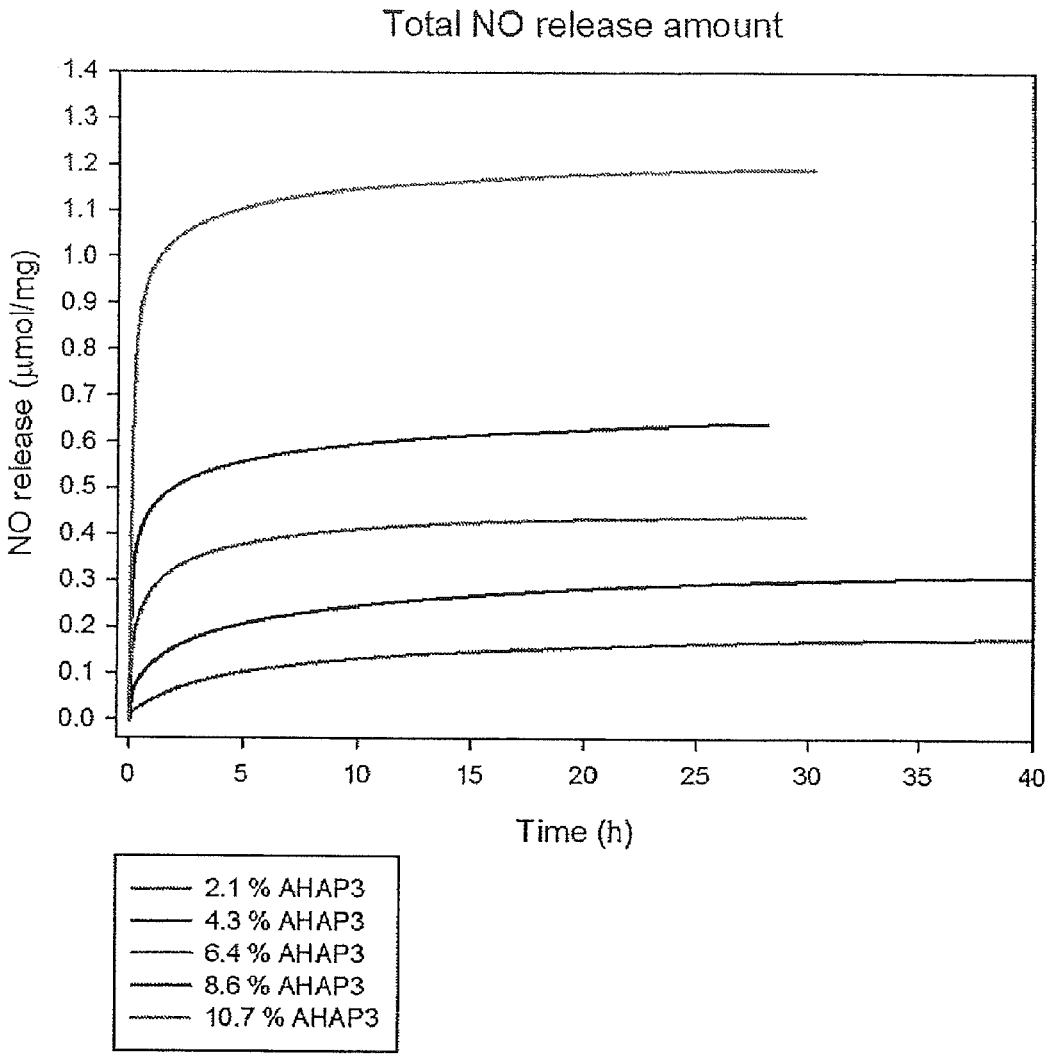
FIG. 10 is a graph illustrating the total release amount of nitric oxide from the nanofibers produced according to Examples 6 to 10 over time.

FIG. 10 illustrates the release cumulative amount of nitric oxide over time in nanofibers produced according to Examples 6 to 10. Referring to FIG. 10, it can be seen that the release amount of nitric oxide is decreased and the rate of increase in the cumulative amount is decreased as time passes, and it can be confirmed that the case of Example 10 (10.7 mol % of AHAP3) is largest and the case of Example 6 (2.1 mol % of AHAP3) is smallest in the release amount of nitric oxide. The higher the concentration of the aminoalkoxysilane AHAP3 capable of storing nitric oxide is, the higher the filling, amount of nitric oxide is. Therefore, the release amount of nitric oxide capable of being released is also increased.

Figure 11:
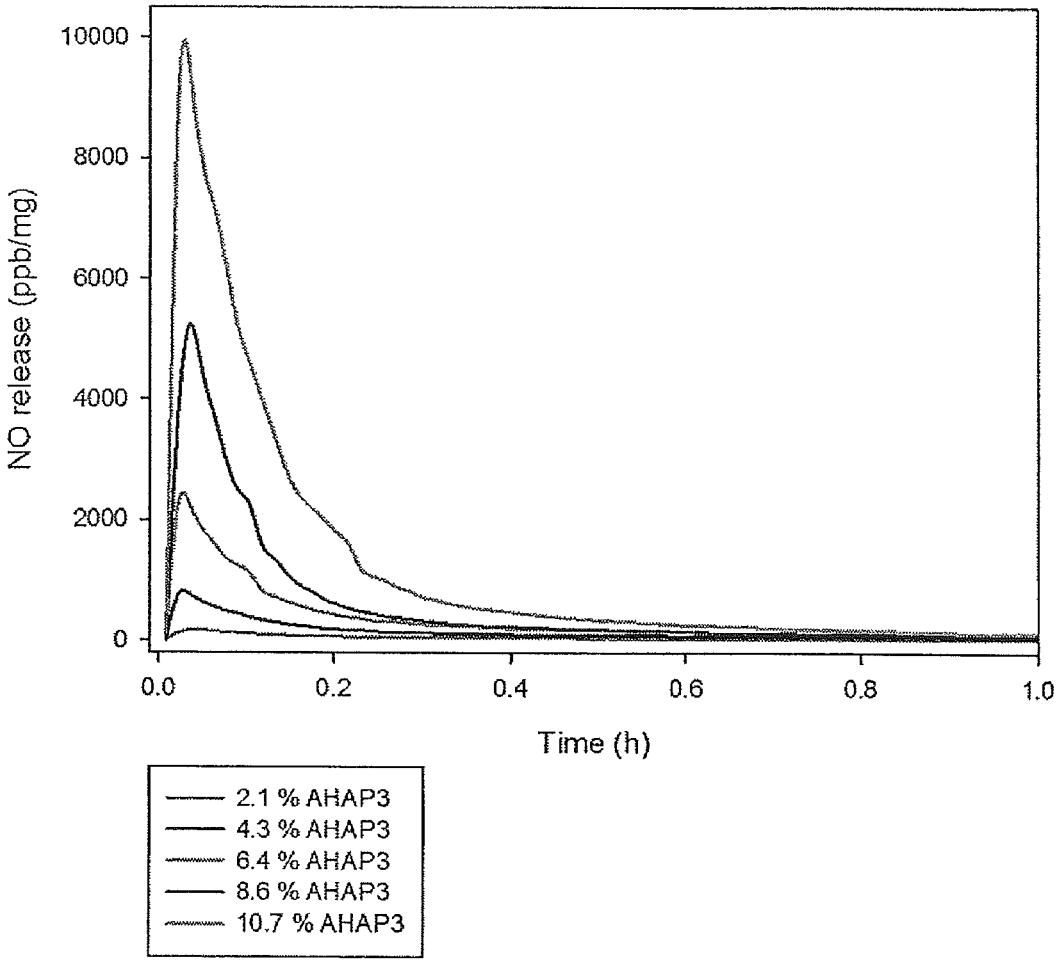
FIG. 11 is a graph illustrating the amount of nitric oxide released from the nanofibers produced according to Examples 6 to 10 over time.

FIG. 11 illustrates the release amount of nitric oxide over time in nanofibers produced according to Examples 6 to 10. Referring to FIG. 11, it can be confirmed that the release amount exhibits a tendency to rapidly reach a maximum value as time passes, and then be gradually decreased. Furthermore, it can be confirmed that the release maximum value of nitric oxide reached is varied for each Example, and from this, it can be seen that the release amount of nitric oxide may be appropriately controlled by appropriately controlling the concentration of aminoalkoxysilane. The amounts of nitric oxide required for each portion in vivo may be different from each other, and these requirements may be fully satisfied by controlling the concentration of aminoalkoxysilane. Accordingly, it can be seen that the application scope thereof is very wide.

The terms used in the present invention are used merely to describe particular Examples, and are not intended to limit the present invention. It is to be seen that a singular expression includes a plural expression unless clearly described in the context. The term "include" or "have" means that characteristics, figures, steps, operations, constituent elements, or combinations thereof described in the specification are present, and is not provided to exclude these. The present invention is not limited by the above-described exemplary embodiments and the accompanying drawings, and is intended to be limited by the accompanying claims. Therefore, various substitutions, modifications, and changes can be made by a person with ordinary skill in the art within the scope not departing from the technical spirit of the present invention described in the claims, and can also fall within the scope of the present invention.

What is claimed is:

1. A nanofiber capable of storing and transferring nitric oxide, which is produced by the method comprising:

a filling step for filling a first material with nitric oxide;

a synthesis step for synthesizing a second material having a —$Si(OCH_3)_3$ functional group capable of covalently bonding to the first material filled with nitric oxide to perform a sol-gel reaction;

a sol-gel reaction step for carrying out a sol-gel reaction of the first material filled with nitric oxide with the second material to form a gel of a network structure; and an electrospinning step for using an electrospinning process to produce a nanofiber with the gel, wherein the first material comprises a material having an amine functional group and an alkoxy group.

2. The nanofiber of claim 1, wherein the first material comprises aminoalkoxysilane.

3. The nanofiber of claim 2, wherein the aminoalkoxysilane comprises one or more selected from the group consisting of N-(6-aminohexyl) aminopropyltrimethoxysilane (AHAP3), N-(2-aminoethyl)-3-aminopropyltritnethoxysilane (AEAP3), N-(2-aminoethyl) aminophenethyltrimethoxysilane (AEMP3), (3-trimethoxysilylpropyl) diethylenetriamine (DET3), methylaminopropyltrimethoxysilane (MAP3), N-(acetylglycyl)-3-aminopropyltrimethoxysilane, N-(3-acryloxy-2-hydroxypropyl)-3-aminopropyltriethoxysilane, N-(2-aminoethyl)-3-aminoisobutylmethyldimethoxysilane, N-(2-aminoethyl)-3-aminopropylmethyldiethoxysilane, N-(2-aminoethyl)-3-aminopropylinethyldimethoxysilane, N-(2-aminoethyl)-3-aminopropylsilanetriol, N-(2-aminoethyl)-3-aminopropyitriethoxysilane, N-(6-aminohexyl) aminomethyltriethoxysilane, N-(2-aminoethyl)-11-aminoundecyltrimethoxysilane, N-[3-amino (polypropylenoxy)]aminopropyltrimethoxysilane, 3-aminopropylsilanetriol, N-(2-N-benzylamino ethyl)-3-aminopropyl trimethoxysilane hydrochloride, and a combination thereof.

4. The nanofiber of claim 1, wherein the second material is a polymer capable of being electrospun.

5. The nanofiber of claim 1, wherein the second material comprises one or more selected from the group consisting of polymethylmethacrylate (PMMA), nylon-6,6 (PA-6,6), polyurethanes (PU), polybenzimidazole (PBI), polycarbonate (PC), polyacrylonitrile (PAN), polyvinyl alcohol (PVA), polylactic acid (PLA), polyethylene-co-vinyl acetate (PEVA), polymethacrylate (PMA), polyethylene oxide (PEO), polyaniline (PANI), polyvinylcarbazole, polyethylene terephthalate (PET), polyacrylic acid-polypyrenemethanole (PAA-PM), polystyrene (PS), polyimide (PA), polyvinylphenol (PVP), polyvinylchloride (PVC), cellulose acetate (CA), polyacrylamide (PAAm), poly(lactic-co-glycolic acid) (PLGA), collagen, polycaprolactone (PCL), poly (2-hydroxyethyl methacrylate) (HEMA), poly(vinylidene fluoride) (PVDF), polyether imide (PEI), polyethylene glycol (PEG), nylon-4,6(PA-4,6), poly(ferrocenyldimethylsilane) (PFDMS), poly(ethylene-co-vinyl alcohol), polyvinyl pyrrolidone (PVP), polymetha-phenyleneisophthalamide, and a combination thereof.

6. The nanofiber of claim 1, wherein the filling step is carried out by a process of dissolving the first material in a solvent, and then increasing the pressure of nitric oxide.

7. The nanofiber of claim 1, wherein the sol-gel reaction is carried out at −10 to 30° C. and a pH of 5 to 10 for 1 to 6 hours.

8. The nanofiber of claim 1, wherein the nanofiber comprises network structure formed by the sol-gel reaction of the first material filled with nitric oxide and the second material.

9. A method for producing nanofibers storing and transferring nitric oxide, the method comprising:

a filling step for filling a first material with nitric oxide;

a synthesis step for synthesizing a second material having a $—Si(OCH_3)_3$ functional group capable of covalently bonding to the first material filled with nitric oxide to perform a sol-gel reaction;

a sol-gel reaction step for carrying out a sol-gel reaction of the first material filled with nitric oxide with the second material to produce a gel of a network structure; and an electrospinning step for using an electrospinning process to produce a nanofiber with the gel, wherein the first material comprises a material having an amine functional group and an alkoxy group in the molecule.

10. The method of claim 9, wherein the first material comprises aminoalkoxysilane.

11. The method of claim 10, wherein the aminoalkoxysilane comprises one or more selected from the group consisting of N-(6-arninohexyl) aminapropyltrimethoxysilane (AHAP3), N-(2-aminoethyl)-3-arninopropyltrimethoxysilane (AEAP3), N-(2-aminoethyl) aminophenethyltrimethoxysilane (AEMP3), (3-trimethoxysilylpropyl) diethylenetriamine (DET3), methylaminopropyltrimethoxysilane (MAP3), N-(acetylglycyl)-3-arninopropyltrimethoxysilane, N-(3-acryloxy-2-hydroxypropyl)-3-aminopropyltriethoxysilane, N-(2-aminoethyl)-3-arninoisobutylmethyldimethoxysilane, N-(2-aminoethyl)-3-aminopropylmethykliethoxysilane, N-(2-aminoethyl)-3-aminopropylmethyldimethoxysilane, N-(2-aminoethyl)-3-aminopropylsilanetriol, N-(2-aminoethyl)-3-aminopropyltriethoxysilane, N-(6-aminohexyl) aminomethyltriethoxysilane, N-(2-aminoethyl)-11-amin-oundecyltrimethoxysilane, N[3-amino(polypropylenoxy)] aminopropyltrimethoxysilane, 3-aminopropylsilanetriol, N-(2-N-benzylamino ethyl)-3-aminopropyl trimethoxysilane hydrochloride, and a combination thereof.

12. The method of claim 9, wherein the second material is a polymer capable of being electrospun.

13. The method of claim 10, wherein the second material comprises one or more selected from the group consisting of polymethylmethacrylate (PMMA), nylon-6,6 (PA-6,6), polyurethanes (PU), polybenzimidazole (PBI), polycarbonate (PC), polyacrylonitrile (PAN), polyvinyl alcohol (PVA), polylactic acid (PLA), polyethylene-co-vinyl acetate (PEVA), polymethacrylate (PMA), polyethylene oxide (PEO), polyaniline (PANI), polyvinylcarbazole, polyethylene terephthalate (PET), polyacrylic acid-polypyrenemethanole (PAA-PM), polystyrene (PS), polyamide (PA), polyvinylphenol (PVP), polyvinylchloride (PVC), cellulose acetate (CA), polyacrylamide (PAAm), poly(lactic-co-glycolic acid) (PLGA), collagen, polycaprolactone (PCL), poly (2-hydroxyethyl methacrylate) (HEMA), poly(vinylidene fluoride) (PVDF), polyether imide (PEI), polyethylene glycol (PEG), nylon-4,6 (PA-4,6), poly(ferrocenyldimethylsilane) (PFDMS), poly(ethylene-co-vinyl alcohol), polyvinyl pyrrolidone (PVP), polymetha-phenyleneisophthalamide, and a combination thereof.

14. The method of claim 11, wherein the filling step is carried out by a process of dissolving the first material in a solvent, and then increasing the pressure of nitric oxide.

15. The method of claim 12, wherein the sol-gel reaction is carried out at −10 to 30° C. and a pH of 5 to 10 for 1 to 6 hours.

* * * * *